US010211505B1

(12) United States Patent
Lewellen, IV et al.

(10) Patent No.: US 10,211,505 B1
(45) Date of Patent: Feb. 19, 2019

(54) SIDELINE RADIO-FREQUENCY POWER COUPLER

(71) Applicant: LOS ALAMOS NATIONAL SECURITY, LLC, Los Alamos, NM (US)

(72) Inventors: John W. Lewellen, IV, Los Alamos, NM (US); Dinh Cong Nguyen, Los Alamos, NM (US); Cynthia Eileen Buechler, Los Alamos, NM (US); Gregory E. Dale, Los Alamos, NM (US); Dale Allen Dalmas, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 64 days.

(21) Appl. No.: 15/615,659

(22) Filed: Jun. 6, 2017

(51) Int. Cl.

| | |
|---|---|
| ***H01P 5/08*** | (2006.01) |
| ***H01P 5/04*** | (2006.01) |
| ***H01P 1/26*** | (2006.01) |
| ***H01P 5/18*** | (2006.01) |

(52) U.S. Cl.
CPC ..... *H01P 5/04* (2013.01); *H01P 1/264* (2013.01); *H01P 5/08* (2013.01); *H01P 5/183* (2013.01)

(58) Field of Classification Search
CPC ..... H01P 5/02; H01P 5/04; H01P 5/18; H01P 5/08; H01P 5/00; H01P 5/103; H01P 5/183
USPC ..... 333/24 R, 239
See application file for complete search history.

(56) References Cited

U.S. PATENT DOCUMENTS

| | | | | |
|---|---|---|---|---|
| 4,675,622 | A * | 6/1987 | Taya | H01B 11/1891 333/115 |
| 5,550,523 | A * | 8/1996 | Rouet | H01F 17/045 323/355 |
| 2016/0079648 | A1* | 3/2016 | Wang | H01P 5/085 333/24 R |

* cited by examiner

*Primary Examiner* — Stephen E. Jones
(74) *Attorney, Agent, or Firm* — Lewis Roca Rothgerber Christie LLP

(57) ABSTRACT

Provided is a resonant structure including a microwave cavity and a sideline radio-frequency (RF) power coupler including: an inner conductor; an outer conductor sharing a central axis with the inner conductor, the outer conductor being electrically coupled to an outer wall of the microwave cavity; and an insulation layer between the inner conductor and the outer conductor.

20 Claims, 8 Drawing Sheets
(8 of 8 Drawing Sheet(s) Filed in Color)

SIDELINE RADIO-FREQUENCY POWER COUPLER

STATEMENT REGARDING FEDERALLY SPONSORED RESEARCH OR DEVELOPMENT

The United States government has rights in this invention pursuant to Contract No. DE-AC52-06NA25396 between the United States Department of Energy and Los Alamos National Security, LLC for the operation of Los Alamos National Laboratory.

FIELD

One or more aspects of embodiments according to the present invention relate to a radio-frequency (RF) power coupler and more particularly, to a sideline RF power coupler for transmitting power into a microwave cavity.

BACKGROUND

Traditional power coupler systems such as on-axis coax or end-butt waveguide systems, are very large in size compared to a single cavity system. When an RF source is powerful enough to drive multiple cavities through the traditional power coupler system at once, this is a small compromise to make. However, when one wishes to drive every cavity independently, with its own RF source or with several sources ganged to a single cavity, these couplers may become impractical.

To make use of an end-butt waveguide coupler, the RE power is typically transferred from a coaxial line to a rectangular waveguide, then passed through a waveguide taper for size constraints, and finally to the cavity. Each transition poses the opportunity for losses and reflections.

Related art loop coupling may be fragile. The loop size is typically defined by the coupling utilized, which in turn, places an upper bound on the size of the conductor used to make the loop, and therefore on its mechanical strength. Further, loops may become increasingly difficult to attach and tune as the cavity size is reduced and frequency increased.

SUMMARY

Aspects of embodiments according to the present invention relate to a radio-frequency (RF) power coupler and more particularly, to a sideline RF power coupler for transmitting power into a microwave cavity.

According to an embodiment of the present invention, there is provided a resonant structure including: a microwave cavity; and a sideline radio-frequency (RF) power coupler including: an inner conductor; an outer conductor sharing a central axis with the inner conductor, the outer conductor being electrically coupled to an outer wall of the microwave cavity; and an insulation layer between the inner conductor and the outer conductor.

The sideline RF power coupler may be configured with the microwave cavity to provide the microwave cavity with an electric field having a uniform direction along a central axis of the microwave cavity.

The sideline RF power coupler may be configured with the microwave cavity to provide the microwave cavity with an electric field having a high strength along a central axis of the microwave cavity compared to other areas of the microwave cavity.

A stub of the sideline RF power coupler may extend beyond the microwave cavity.

The sideline RF power coupler may be configured with the microwave cavity to provide the microwave cavity with an electromagnetic field having an amplitude that is adjustable by changing a length of the stub of the sideline RF power coupler.

The sideline RF power coupler may be configured with the microwave cavity to provide the microwave cavity with an electromagnetic field having an amplitude that is adjustable by changing termination conditions at an end of the stub of the sideline RF power coupler.

The central axis of the inner and outer conductors may be parallel to a central axis of the microwave cavity.

According to an embodiment of the present invention, there is provided a sideline radio-frequency (RE) power coupler including: an inner conductor; an outer conductor sharing a central axis with the inner conductor, the outer conductor being electrically coupled to an outer wall of a microwave cavity; and an insulation layer between the inner conductor and the outer conductor.

The sideline RF power coupler may be configured with the microwave cavity to provide the microwave cavity with an electric field having a uniform direction along a central axis of the microwave cavity.

The sideline RF power coupler may be configured with the microwave cavity to provide the microwave cavity with an electric field having a high strength along a central axis of the microwave cavity compared to other areas of the microwave cavity.

A stub of the sideline RF power coupler may extend beyond the microwave cavity.

The sideline RF power coupler may be configured with the microwave cavity to provide the microwave cavity with an electromagnetic field having an amplitude that is adjustable by changing a length of the stub of the sideline RF power coupler.

The sideline RF power coupler may be configured with the microwave cavity to provide the microwave cavity with an electromagnetic field having an amplitude that is adjustable by changing termination conditions at an end of the stub of the sideline RF power coupler.

The central axis of the inner and outer conductors may be parallel to a central axis of the microwave cavity.

According to an embodiment of the present invention, there is provided a method of transmitting radio-frequency (RF) power into a microwave cavity, the microwave cavity having a sideline RF power coupler coupled thereto, the sideline RF power coupler including an inner conductor, an outer conductor sharing a central axis with the inner conductor, the outer conductor being electrically coupled to an outer wall of the microwave cavity, and an insulation layer between the inner conductor and the outer conductor, the method including: applying power from a power source to the sideline RF power coupler; and providing RF power via an aperture between the sideline RF power coupler and the microwave cavity, to the microwave cavity.

The RF power may be provided to the microwave cavity such that an electric field has a uniform direction along a central axis of the microwave cavity.

The RE power may be provided to the microwave cavity such that an electric field has a high strength along a central axis of the microwave cavity compared to other areas of the microwave cavity.

A stub of the sideline RF power coupler may extend beyond the microwave cavity.

The RF power may be provided to the microwave cavity such that an electromagnetic field having an amplitude that is adjustable by changing a length of the stub of the sideline RF power coupler.

The RF power may be provided to the microwave cavity such that an electromagnetic field has an amplitude that is adjustable by changing termination conditions at an end of the stub of the sideline RF power coupler.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

These and other features and aspects of the present invention will be appreciated and understood with reference to the specification, claims, and appended drawings wherein:

DETAILED DESCRIPTION

Figure 1:
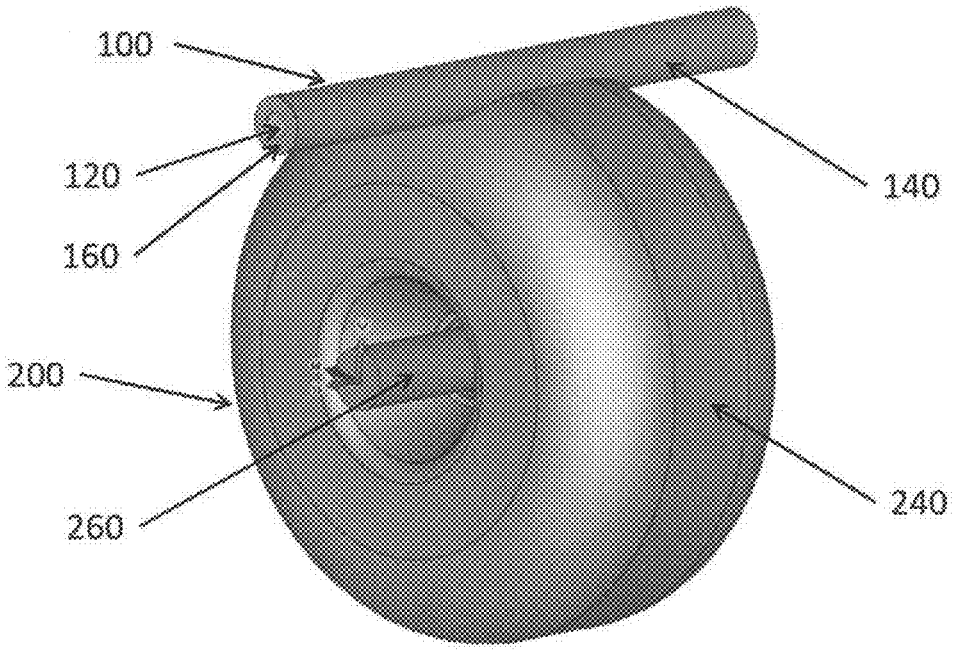
FIG. 1 is an oblique view of the exterior of a microwave cavity with an attached radio-frequency (RF) sideline power coupler according to an embodiment of the present invention.

Aspects of embodiments according to the present invention relate to an RF power coupler and more particularly, to a sideline RF power coupler for transmitting power into a microwave cavity.

The detailed description set forth below in connection with the appended drawings is intended as a description of exemplary embodiments of the present invention provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

According to an embodiment of the present invention, a sideline RF power coupler provides a mechanism of transmitting radio-frequency (RF) power into a microwave cavity or structure. Sideline RF power couplers, according to embodiments of the present invention, may be compact compared to the size of the microwave cavity or structure. Further, multiple couplers may be attached onto the same microwave cavity or structure. Depending upon the RF source, embodiments of the present invention may allow the overall RF system to be implemented with fewer waveguide-to-waveguide conversions compared to related art devices.

As compared to a related art rectangular waveguide-type coupler, embodiments of the present invention may have broad external tunability of coupling and may preserve nearly full access to the circumference of the microwave cavity or structure.

As compared to a related art loop antenna-type coupler, embodiments of the present invention may have an intrinsically stronger and less perturbative intra-cavity structure, may have no intra-cavity moving parts to adjust the coupling, may have intrinsic insensitivity to undesired cavity modes when adjusting the coupling, and may have simplified external mechanical system for adjusting the coupling.

Some embodiments of the present invention may be used in an accelerator in a satellite. Embodiments of the present invention may be compact, efficient, and robust enough to survive launch into space. Further, the sideline power coupler may be a more space-efficient method for coupling radio-frequency (RF) energy from moderate-power sources, such as solid-state high-electron-mobility transistor (HEMT) amplifiers, into resonant cavities when compared to related art devices.

Related art power coupler methods, such as on-axis coax or end-butt waveguide, may be very large in size compared to a single cavity. When an RF source is powerful enough to drive multiple cavities at once, this is a small compromise to make. When each cavity is driven independently, with its own RF source or with several sources ganged to a single cavity, large couplers may be less practical.

Further, embodiments of the present invention may reduce the number of transmission path transitions to make compared to related art devices. For example, to make use of an end-butt waveguide coupler, the RF power may be transferred from a coaxial line (the HEMT output) to rectangular waveguide, passed through a waveguide taper for size constraints; and then transferred to the cavity. Each transition poses the opportunity for losses and reflections. As another example, to make use of an on-axis coax line, the power may be transferred from coax line to waveguide, then transferred to large-radius hollow-central-conductor coax, and then delivered to the cavity.

Embodiments of the present invention provide a method of using a single coaxial line, located at the perimeter of a cavity, to provide RF power to that cavity. Embodiments of the present invention may occupy reduced or minimal longitudinal space at either end of the cavity, and multiple couplers can readily be ganged to a single cavity.

Embodiments of the present invention may provide a sideline coupler which allows the coupling coefficient to be varied without requiring any mechanical motion to occur within the cavity, further improving robustness as compared to a related art loop-type coupler.

Embodiments of the present invention may enable low-cost, highly redundant, modular particle beam accelerators. Potential application spaces include, but is not limited to, research (ultrafast electron diffraction and microscopy, pure beam related research), medicine (radiotherapy, radioisotope production, etc.), industrial (radiography, medical device sterilization, flue gas treatment, etc.), and national security (cargo inspection). Embodiments of the present invention may drive development of novel types of RF structures which heretofore were impractical because of power-feed difficulties; examples include specific structure designs intended to deflect or focus charged-particle beams. While some embodiments of the present invention are directed to electron beam applications, other embodiments of the present invention are applicable to RF cavities independent of the particles being accelerated, or the use for which the cavity is being utilized. Thus, embodiments of the present invention have applications for other particle species (e.g. protons), or for RF cavities in general (e.g. materials science probes, resonant filters, etc.).

Figure 2:
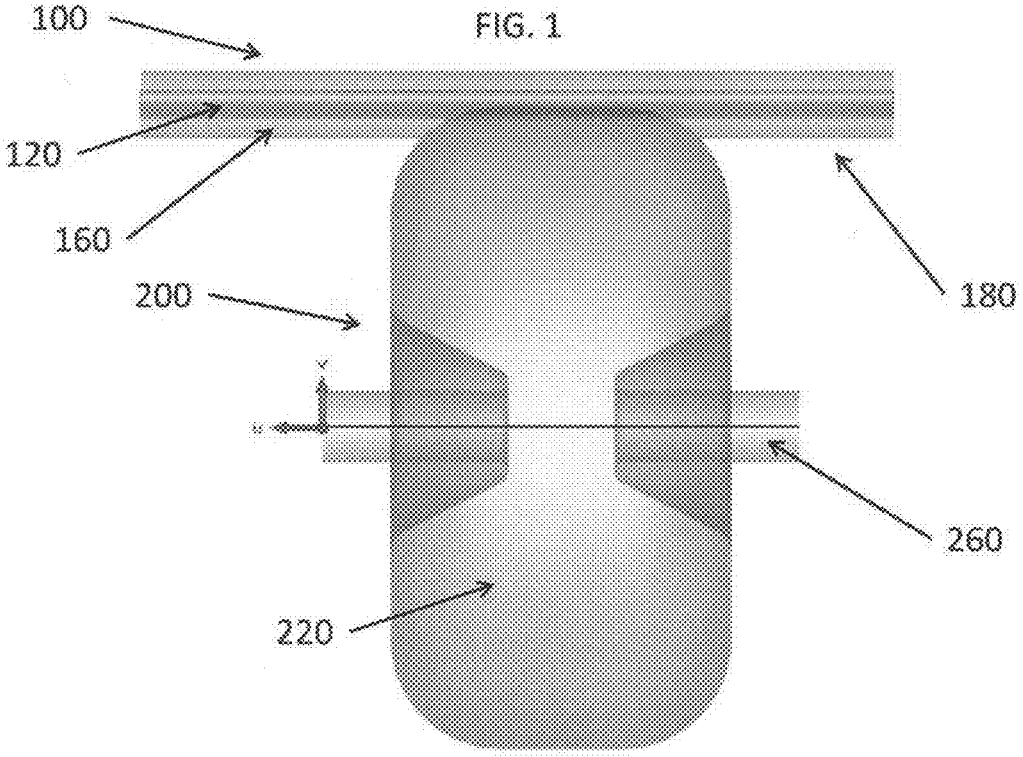
FIG. 2 is a cross-sectional view of a microwave cavity with an attached sideline RF power coupler according to an embodiment of the present invention.
Figure 3:
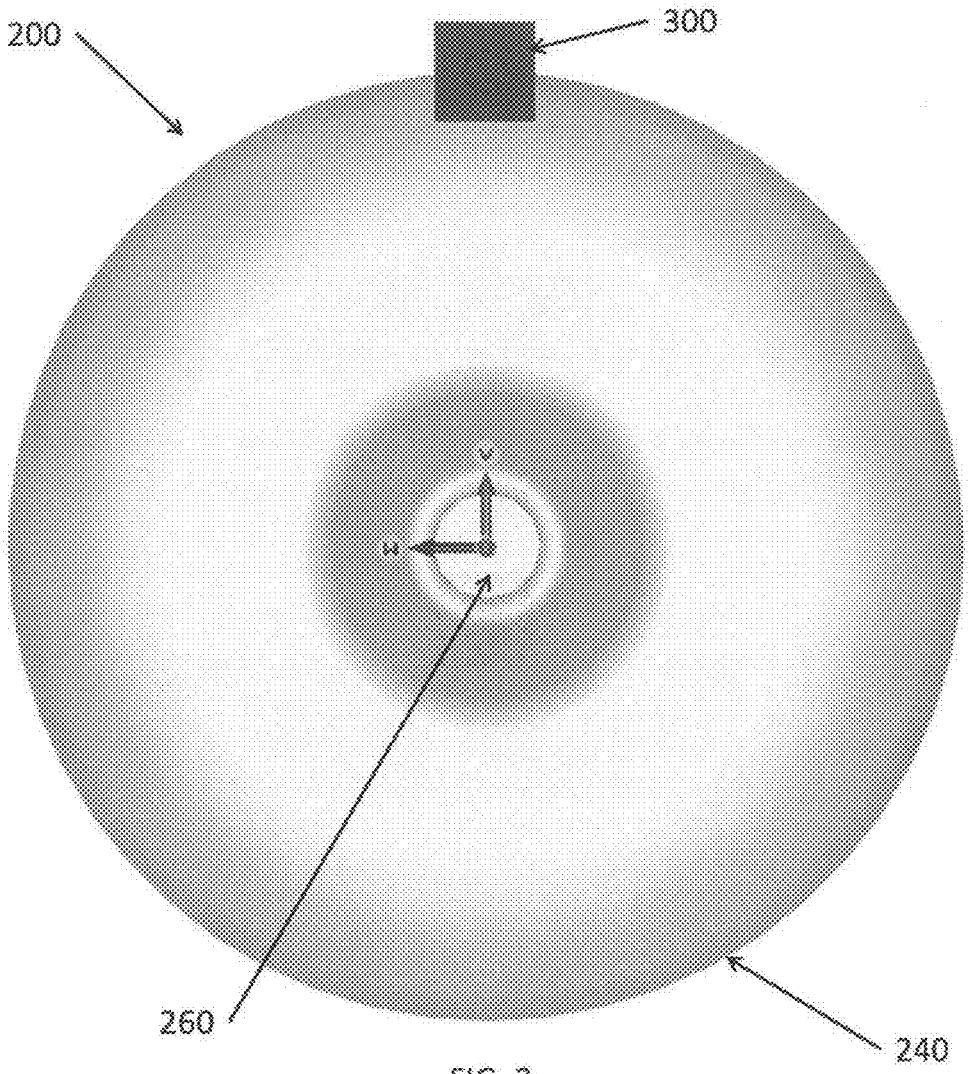
FIG. 3 is an end view of a microwave cavity with an attached sideline RF power coupler according to an embodiment of the present invention.

FIG. 1 is an oblique view of the exterior of a microwave cavity with an attached sideline RF power coupler according to an embodiment of the present invention. FIG. 2 is a cross-sectional view of a microwave cavity with an attached sideline RF power coupler according to an embodiment of the present invention. FIG. 3 is an end view of a microwave cavity with an attached sideline RF power coupler according to an embodiment of the present invention. According to the embodiments of FIGS. 1-3, a sideline RF power coupler 100 is coupled to a microwave cavity 200.

The sideline RF power coupler 100 includes inner conductor 120, outer conductor 140, and an insulation layer 160 between the inner and outer conductors. A first end of the sideline RF power coupler 100 may be coupled to a power source 300. A portion of the sideline RF power coupler 100 that extends beyond the microwave cavity 200 (e.g., a second end of the sideline RF power coupler 100) may be termed a stub 180.

The insulation layer 160 may include a dielectric material (e.g., Teflon), air, and/or vacuum. For example, the insulation layer may be a layer added between the inner and outer conductors or may be an air gap or a vacuum gap. The insulation layer 160 may prevent the inner and outer conductors from being in electrical contact with each other.

The microwave cavity 200 includes a cylindrically symmetrical outer wall 240, hollow cavity 220 defined by or enclosed by the outer wall 240, and a central tube 260. A central axis of the central tube 260 is aligned with the u-axis of the shown (u, v, w) Cartesian coordinate system. A central axis of the inner and outer conductors 120 and 140 of the sideline RF power coupler 100 is parallel to the central axis of the central tube 260 and the u-axis. The microwave cavity 200 is formally referred to as a "cylindrically symmetric reentrant cavity" and is here for illustrative purposes. The sideline RF power coupler 100 may be attached to other types of microwave resonant structures and cavities, including those referred to in the literature as "pillbox," "elliptical," "rectangular," "quarter-wave," "half-wave," "spoke," etc.

The sideline RF power coupler 100 receives RF power from the power source 300 and provides the RF power to the hollow cavity 220 of the microwave cavity 200 via an interface or aperture between the sideline RF power coupler 100 and the microwave cavity 200. According to some embodiments, the power source 300 may be a solid-state high-electron-mobility transistor (HEMT) amplifier.

According to the embodiments of FIGS. 1-3, the inner conductor 120 is a solid cylindrical wire. The outer conductor 140 is a hollow cylindrical shield sharing a central axis with the inner conductor 120. A portion of the outer conductor 140 is removed (or is not present) in order to create an opening. The opening coincides with the microwave cavity 200. The outer conductor 140 is electrically coupled to the outer wall 240 of the microwave cavity 200. A portion of the insulation layer 160 may be removed (or is not present) at the opening.

The central tube 260 of the microwave cavity 200 creates a path through which particles (e.g., an electron, a proton, etc.) travel (e.g., when in a particle accelerator), but the present invention is not limited thereto. For example, applications such as material science probes or resonant filters may not have particles travelling therethrough.

Figure 4:
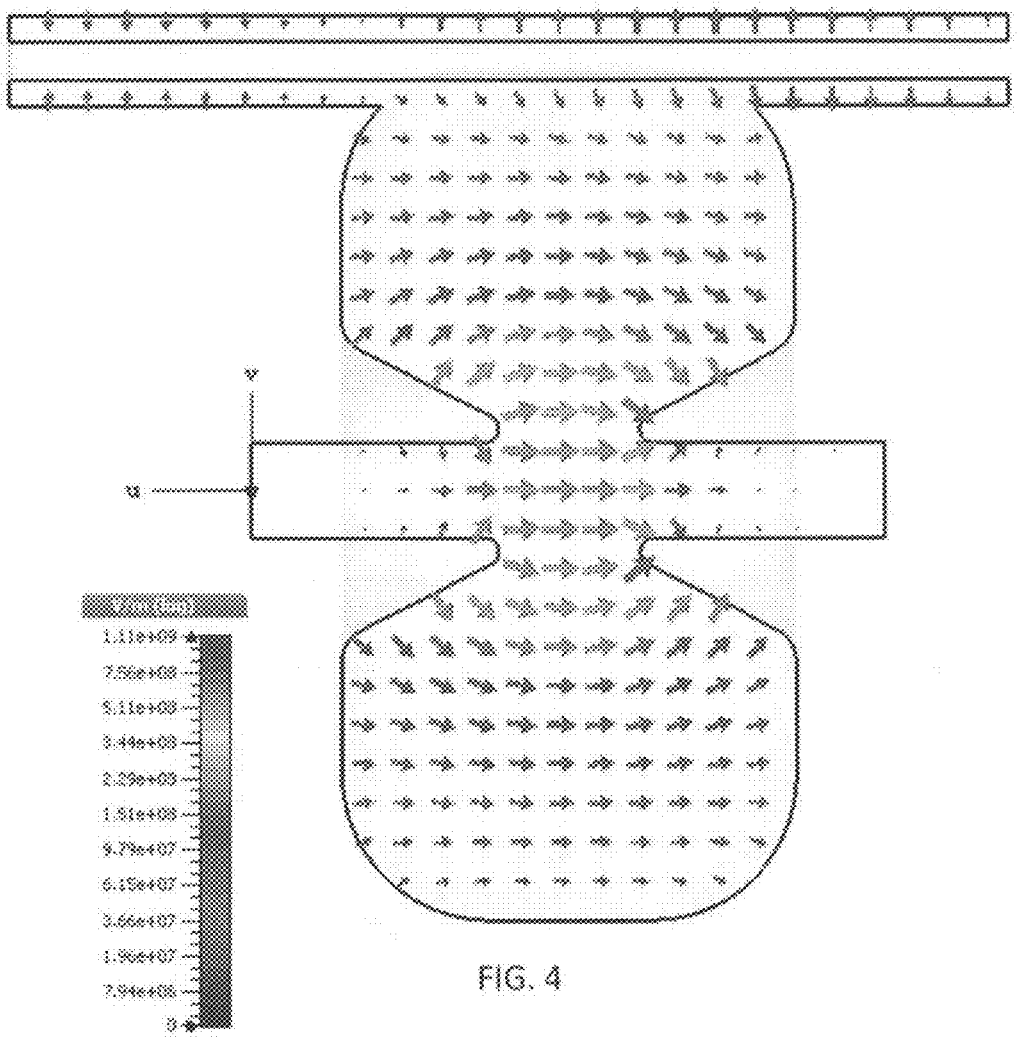
FIG. 4 is a cross-sectional view of a microwave cavity with an attached sideline RF power coupler showing electromagnetic fields according to an embodiment of the present invention, with the coupler configured for high coupling (strong transmission of power to the cavity)
Figure 5:
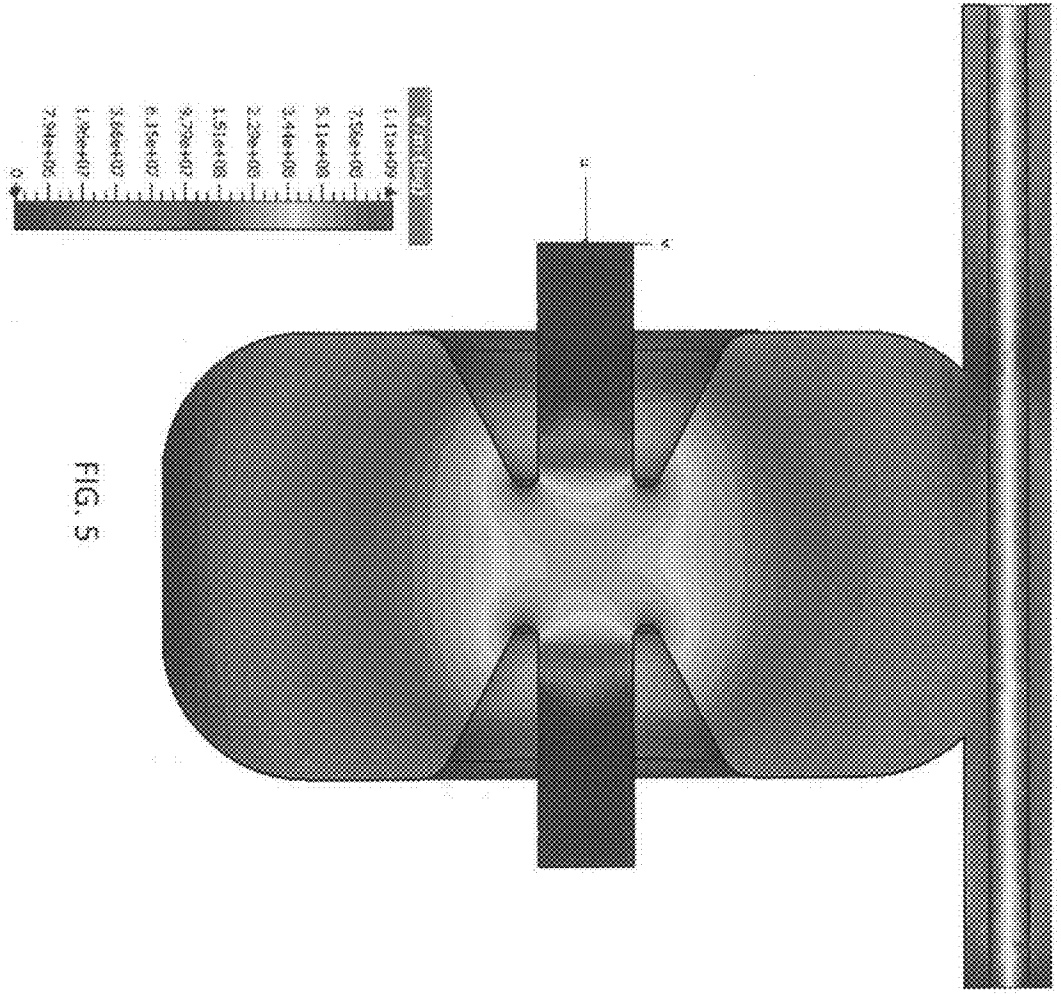
FIG. 5 is a cross-sectional view of the microwave cavity with the attached sideline RF power coupler of FIG. 4 showing electromagnetic field amplitudes according to an embodiment of the present invention.
Figure 6:
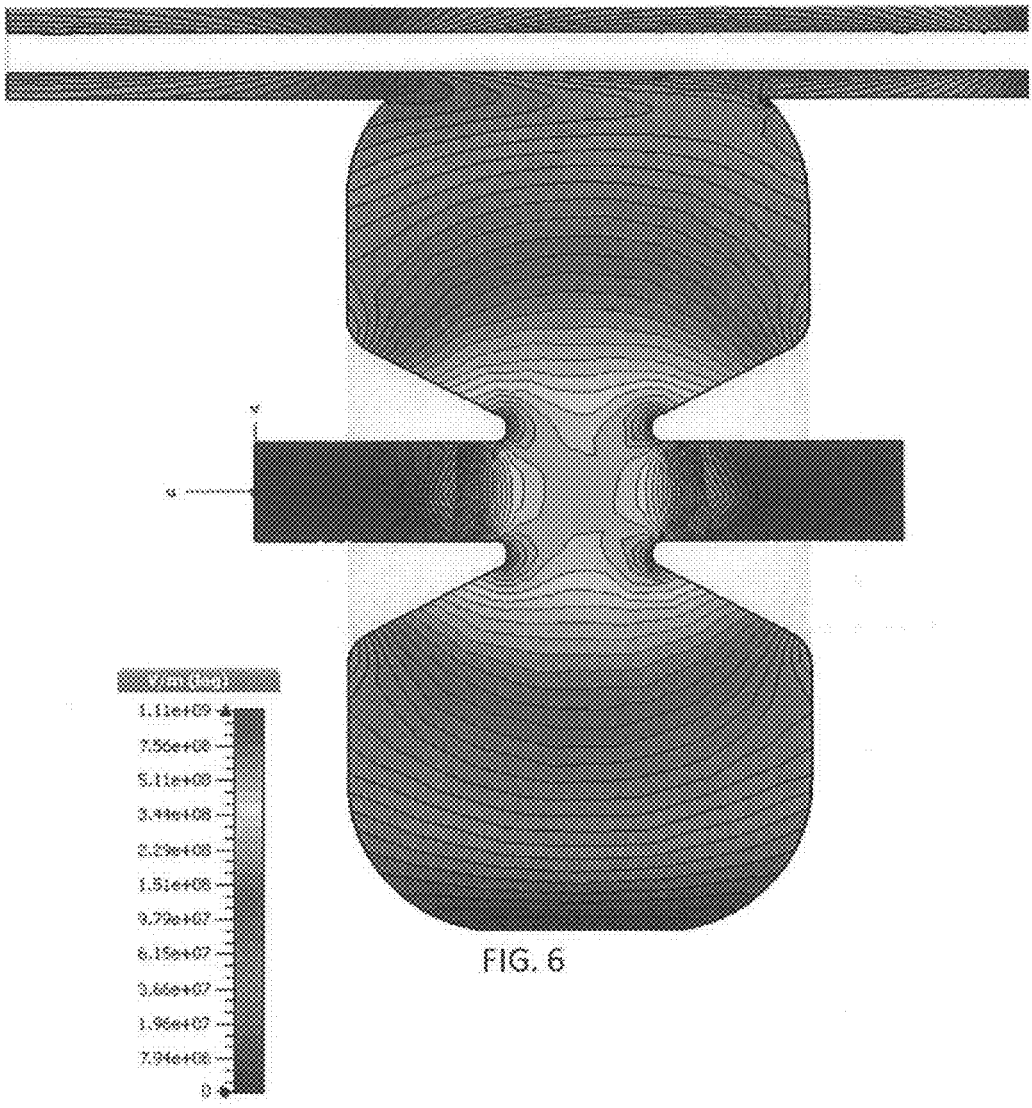
FIG. 6 is another cross-sectional view of the microwave cavity with the attached sideline RF power coupler of FIG. 4 showing electromagnetic field amplitudes and contour lines according to an embodiment of the present invention.

FIG. 4 is a cross-sectional view of a microwave cavity with an attached sideline RF power coupler showing electromagnetic fields according to an embodiment of the present invention, with the coupler configured for high coupling (strong transmission of power to the cavity). FIG. 5 is a cross-sectional view of the microwave cavity with the attached sideline RF power coupler of FIG. 4 showing electromagnetic field amplitudes according to an embodiment of the present invention. FIG. 6 is another cross-sectional view of the microwave cavity with the attached sideline RF power coupler of FIG. 4 showing electromagnetic field amplitudes and contour lines according to an embodiment of the present invention. FIGS. 4-6 each show a different way of presenting the electric field strength within a microwave cavity for the same length stub.

The arrows of FIG. 4 show the strength and direction of the electric field within the microwave cavity and the sideline RF power coupler. In FIG. 4, blue shows the lowest strength electric field and red is the highest. In addition, stronger field lines are represented with a larger arrow. According to this embodiment, it is shown that the amplitude of the RF fields in the resonant cavity are much larger than the amplitude of the fields within the sideline power coupler.

In FIG. 5, the strength of the electric field within the microwave cavity and the sideline RF power coupler is represented by a color gradient. In FIG. 5, blue shows the lowest strength electric field and red is the highest.

In FIG. 6, the strength of the electric field within the microwave cavity and the sideline RF power coupler is represented by a color gradient and gradient lines are also shown. In FIG. 6, blue shows the lowest strength electric field and red is the highest.

As can be seen in FIGS. 4-6, the electric field has high strength along the central tube of the microwave cavity. Further, as can be seen in FIG. 4, the electric field arrows along the central axis of the microwave cavity are all pointing along the central axis of the microwave cavity. The electric field along the central axis of the microwave cavity has a uniform direction. As such, particles traveling through the central tube of the microwave cavity receives power that is input into the microwave cavity from the sideline RF power coupler and the particles are accelerated through the microwave cavity. Other orientations (e.g., diagonal, perpendicular, etc.) of the electric and magnetic fields may be used in accordance with the intended purpose of the cavity, also referred to as the cavity "mode."

Figure 7:
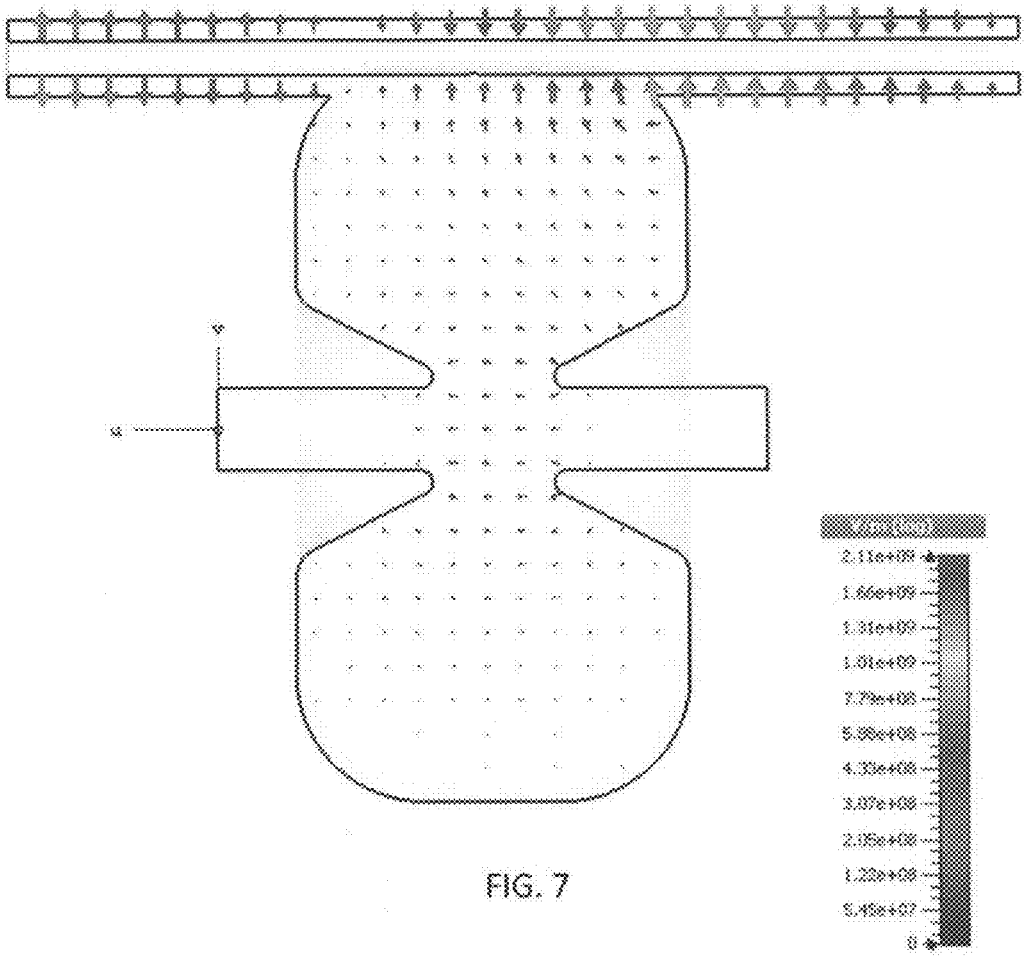
FIG. 7 is a cross-sectional view of another microwave cavity with an attached sideline RF power coupler showing electromagnetic fields according to an embodiment of the present invention, with the coupler configured for low coupling (weak transmission of power to the cavity)
Figure 8:
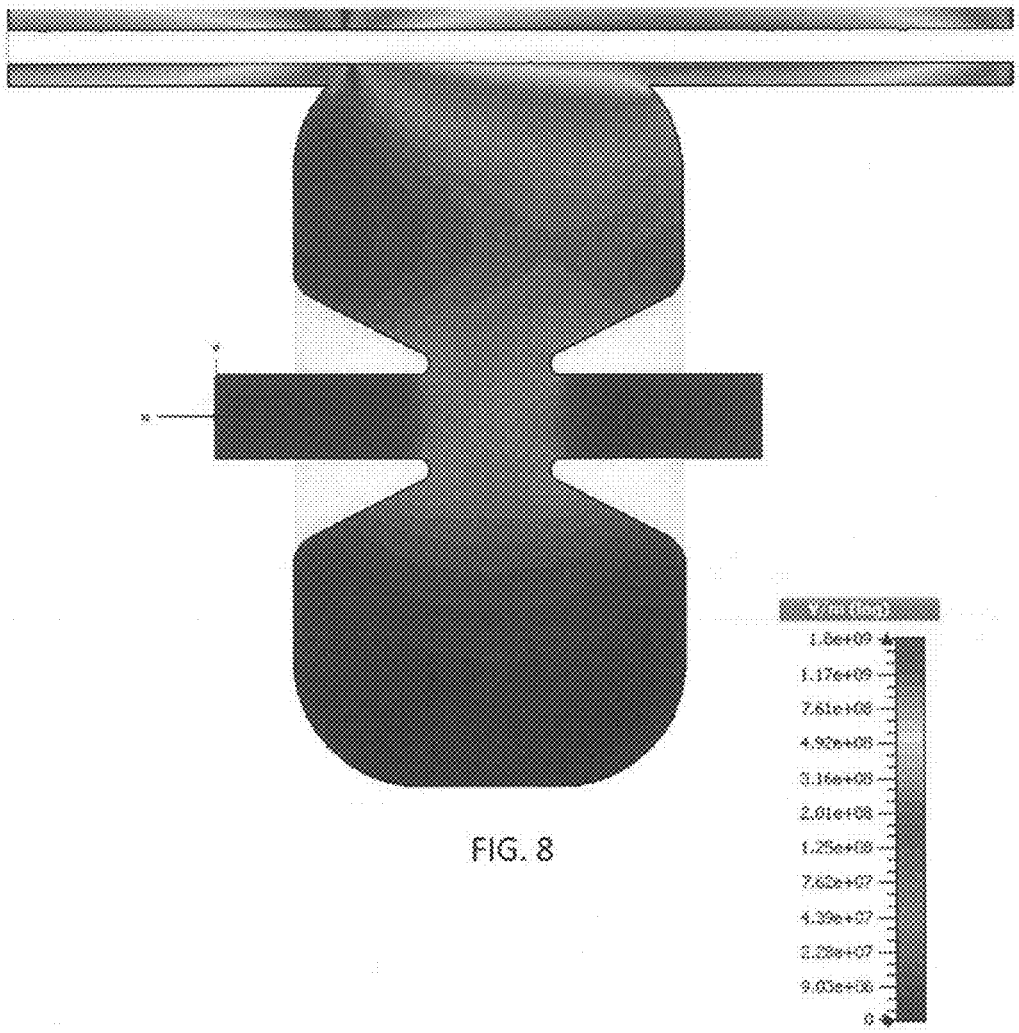
FIG. 8 is a cross-sectional view of the microwave cavity with the attached sideline RF power coupler of FIG. 7 showing electromagnetic field amplitudes according to an embodiment of the present invention.
Figure 9:
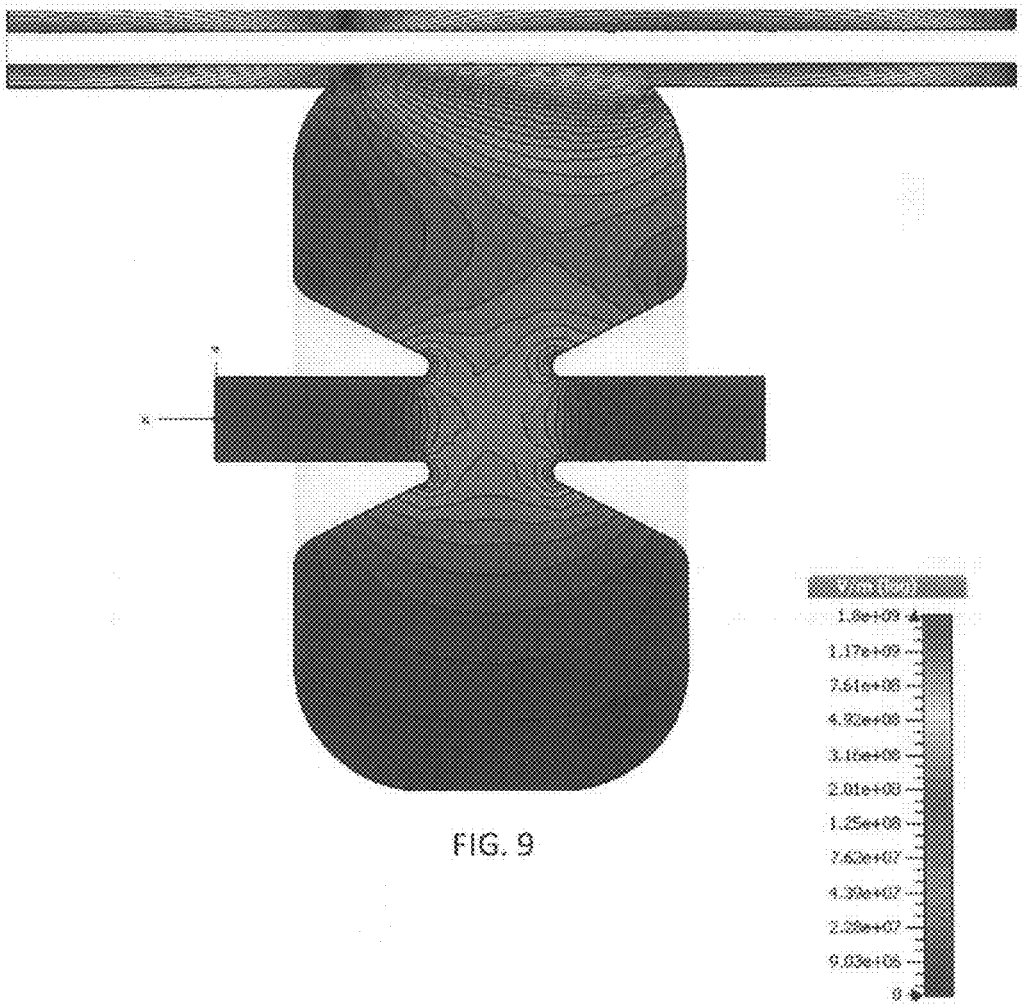
FIG. 9 is another cross-sectional view of the microwave cavity with the attached sideline RF power coupler of FIG. 7 showing electromagnetic field amplitudes and contour lines according to an embodiment of the present invention.

FIG. 7 is a cross-sectional view of another microwave cavity with an attached sideline RF power coupler showing electromagnetic fields according to an embodiment of the present invention, with the coupler configured for low coupling (weak transmission of power to the cavity). FIG. 8 is a cross-sectional view of the microwave cavity with the attached sideline RF power coupler of FIG. 7 showing electromagnetic field amplitudes according to an embodiment of the present invention. FIG. 9 is another cross-sectional view of the microwave cavity with the attached sideline RF power coupler of FIG. 7 showing electromagnetic field amplitudes and contour lines according to an embodiment of the present invention. In FIGS. 7-9, the sideline RF power coupler differs from that of FIGS. 4-6 in that the stub is longer in FIGS. 7-9 than it is in FIGS. 4-6, and as such, the fields in the cavity are much weaker than the fields in the sideline coupler, that is, a much weaker coupling between the sideline coupler and the cavity is obtained solely by changing the length of the stub 180. FIGS. 7-9 each show a different way of presenting the electric field strength within a microwave cavity for the same length stub.

The arrows of FIG. 7 show the strength and direction of the electric field within the microwave cavity and the sideline RF power coupler. In FIG. 7, blue shows the lowest strength electric field and red is the highest. In addition, stronger field lines are represented with a larger arrow.

In FIG. 8, the strength of the electric field within the microwave cavity and the sideline RF power coupler is represented by a color gradient. In FIG. 8, blue shows the lowest strength electric field and red is the highest.

In FIG. 9, the strength of the electric field within the microwave cavity and the sideline RF power coupler is represented by a color gradient and gradient lines are also shown. In FIG. 9, blue shows the lowest strength electric field and red is the highest.

As can be seen in FIGS. 7-9, the electric field has high strength within the sideline RF power coupler and not within the microwave cavity. As such, particles traveling through the central tube of the microwave cavity receive little or no power because little of the power input to the sideline RF power coupler is input into the microwave cavity from the sideline RF power coupler. Therefore the particles' energy has little or no change when travelling though the microwave cavity. The sideline RF power coupler, and therefore the RF power source that drives it, is effectively de-coupled from the microwave cavity.

When comparing FIGS. 4-6 with FIGS. 7-9, it can be seen that the degree of coupling of the sideline RF power coupler to the microwave cavity can be changed based on the length of the stub of the sideline RF power coupler. Typical length changes, or equivalently RF phase shift effected by a variable phase shifter attached to the stub, on the order of ⅛-¼ of an RF wavelength are required to change the coupling from full strength (see FIGS. 4-6) to reduced strength (e.g. minimal strength) (see FIGS. 7-9). The exact length change will depend on several factors, such as the insulation layer chosen, the size of the aperture between the sideline coupler and the cavity, and the exact location of the sideline coupler on the cavity. For a cavity, resonant at 5 GHz, this equates to a length change on the order of 1 cm. As such, the strength of the electric field and the amount of power transferred into the microwave cavity can be varied by varying the length of the stub.

Further, while FIGS. 7-9 have a different length stub from FIGS. 4-6, one of ordinary skill in the art would recognize that similar effects, and therefore similar results, may be achieved by adding or changing a resistance at the end of the stub of the sideline RF power coupler (e.g., a terminal resistance), changing the end of the line from a "shorted" configuration to an "open" configuration, or adding a variable phase shifter. Changing the configuration of the line, and adding or changing a terminal resistance, changes the effective length of wire the RF signal "sees," and an amount of power returned from a reflection at the end of the line, without actually needing to change the length of the wire.

As such, embodiments of the present invention can change the amount of power coupled to a microwave cavity from a sideline RF power coupler without changing the power actually being provided to the sideline RF power coupler from the power source and without utilizing any moving parts inside the cavity.

Further, while FIGS. 1-9 show only a single sideline RF power coupler, the present invention is not limited thereto and a plurality of sideline RF power couplers may be used. The plurality of sideline RF power couplers may be evenly spaced around the perimeter of the microwave cavity or may be unevenly spaced.

In addition, while FIGS. 1-9 show a sideline RF power coupler at the edge of the microwave cavity, the present invention is not limited thereto and one or more sideline RF power couplers may be located at locations other than an edge of the microwave cavity.

Further, while a certain microwave cavity shape is shown in FIGS. 1-9, the present invention is not limited thereto and any suitable resonant cavity may be used. In addition, because, for electrical purposes, only the inner surface of the resonant cavity is "viewed" by the electric field inside the cavity, the thickness of the cavity wall and the inner and outer conductors of the sideline RF power coupler can be varied according to the application. Further, any suitable conductive material may be used for the cavity wall and the inner and outer conductors of the sideline RF power coupler.

In addition, multiple cavities may be connected in series along the central axis of the cavities in order to increase or more finely tune the acceleration of the particles.

Aspects of embodiments according to the present invention relate to an RF power coupler and more particularly, to a sideline RF power coupler for transmitting power into a microwave cavity.

It will be understood that, although the terms "first," "second," "third," etc., may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section without departing from the spirit and scope of the present invention.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," "one of," and "selected from," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Furthermore, "connection," "connected," etc., may also refer to "electrical connection," "electrically connected," etc., depending on the context in which such terms are used as would be understood by those skilled in the art. When an element or layer is referred to as being "directly on," "directly connected to," "directly coupled to," "directly connected with," "directly coupled with," or "immediately adjacent to" another element or layer, there are no intervening elements or layers present.

As used herein, "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

Features described in relation to one or more embodiments of the present invention are available for use in conjunction with features of other embodiments of the present invention. For example, features described in a first embodiment may be combined with features described in a second embodiment to form a third embodiment, even though the third embodiment may not be specifically described herein.

Although this invention has been described with regard to certain specific embodiments, those skilled in the art will have no difficulty devising variations of the described embodiments, which in no way depart from the scope and spirit of the present invention. Furthermore, to those skilled in the various arts, the invention itself described herein will suggest solutions to other tasks and adaptations for other applications. It is the Applicant's intention to cover by claims all such uses of the invention and those changes and modifications which could be made to the embodiments of the invention herein chosen for the purpose of disclosure without departing from the spirit and scope of the invention. Thus, the present embodiments of the invention should be considered in all respects as illustrative and not restrictive, the scope of the invention to be indicated by the appended claims and their equivalents.

What is claimed is:

1. A resonant structure comprising:

a microwave cavity; and a sideline radio-frequency (RF) power coupler comprising:

an inner conductor;

an outer conductor sharing a central axis with the inner conductor, the outer conductor being electrically coupled to an outer wall of the microwave cavity; and an insulation layer between the inner conductor and the outer conductor.

2. The resonant structure of claim 1, wherein the sideline RF power coupler is configured with the microwave cavity to provide the microwave cavity with an electric field having a uniform direction along a central axis of the microwave cavity.

3. The resonant structure of claim 1, wherein the sideline RF power coupler is configured with the microwave cavity to provide the microwave cavity with an electric field having a high strength along a central axis of the microwave cavity compared to other areas of the microwave cavity.

4. The resonant structure of claim 1, wherein a stub of the sideline RF power coupler extends beyond the microwave cavity.

5. The resonant structure of claim 4, wherein the sideline RF power coupler is configured with the microwave cavity to provide the microwave cavity with an electromagnetic field having an amplitude that is adjustable by changing a length of the stub of the sideline RF power coupler.

6. The resonant structure of claim 4, wherein the sideline RF power coupler is configured with the microwave cavity to provide the microwave cavity with an electromagnetic field having an amplitude that is adjustable by changing termination conditions at an end of the stub of the sideline RF power coupler.

7. The resonant structure of claim 1, wherein the central axis of the inner and outer conductors is parallel to a central axis of the microwave cavity.

8. A sideline radio-frequency (RF) power coupler comprising:

an inner conductor;

an outer conductor sharing a central axis with the inner conductor, the outer conductor being electrically coupled to an outer wall of a microwave cavity; and an insulation layer between the inner conductor and the outer conductor.

9. The sideline RF power coupler of claim 8, wherein the sideline RF power coupler is configured with the microwave cavity to provide the microwave cavity with an electric field having a uniform direction along a central axis of the microwave cavity.

10. The sideline RF power coupler of claim 8, wherein the sideline RF power coupler is configured with the microwave cavity to provide the microwave cavity with an electric field having a high strength along a central axis of the microwave cavity compared to other areas of the microwave cavity.

11. The sideline RF power coupler of claim 8, wherein a stub of the sideline RF power coupler extends beyond the microwave cavity.

12. The sideline RF power coupler of claim 11, wherein the sideline RF power coupler is configured with the microwave cavity to provide the microwave cavity with an electromagnetic field having an amplitude that is adjustable by changing a length of the stub of the sideline RF power coupler.

13. The sideline RF power coupler of claim 11, wherein the sideline RF power coupler is configured with the microwave cavity to provide the microwave cavity with an electromagnetic field having an amplitude that is adjustable by changing termination conditions at an end of the stub of the sideline RF power coupler.

14. The sideline RF power coupler of claim 8, wherein the central axis of the inner and outer conductors is parallel to a central axis of the microwave cavity.

15. A method of transmitting radio-frequency (RF) power into a microwave cavity, the microwave cavity having a sideline RF power coupler coupled thereto, the sideline RF power coupler comprising an inner conductor, an outer conductor sharing a central axis with the inner conductor, the outer conductor being electrically coupled to an outer wall of the microwave cavity, and an insulation layer between the inner conductor and the outer conductor, the method comprising:

applying power from a power source to the sideline RF power coupler; and providing RF power via an aperture between the sideline RF power coupler and the microwave cavity, to the microwave cavity.

16. The method of claim 15, wherein the RF power is provided to the microwave cavity such that an electric field has a uniform direction along a central axis of the microwave cavity.

17. The method of claim 15, wherein the RF power is provided to the microwave cavity such that an electric field has a high strength along a central axis of the microwave cavity compared to other areas of the microwave cavity.

18. The method of claim 15, wherein a stub of the sideline RF power coupler extends beyond the microwave cavity.

19. The method of claim 18, wherein the RF power is provided to the microwave cavity such that an electromagnetic field having an amplitude that is adjustable by changing a length of the stub of the sideline RF power coupler.

20. The method of claim 18, wherein the RF power is provided to the microwave cavity such that an electromagnetic field has an amplitude that is adjustable by changing termination conditions at an end of the stub of the sideline RF power coupler.

* * * * *